US007804016B2

(12) United States Patent
Sagoo et al.

(10) Patent No.: US 7,804,016 B2
(45) Date of Patent: Sep. 28, 2010

(54) METHOD AND DEVICE FOR SELECTING MUSIC TO BE RECOMMENDED FOR USER BY USING MUSIC REPRODUCTION DEVICE

(75) Inventors: Kiran Pal Sagoo, Suwon-si (KR); In-sik Myung, Suwon-si (KR); Eun-jung Lee, Suwon-si (KR)

(73) Assignee: Samsung Electronics Co, Ltd., Suwon-si (KR)

( * ) Notice: Subject to any disclaimer, the term of this patent is extended or adjusted under 35 U.S.C. 154(b) by 76 days.

(21) Appl. No.: 12/179,883

(22) Filed: Jul. 25, 2008

(65) Prior Publication Data

US 2009/0025539 A1 Jan. 29, 2009

Related U.S. Application Data

(60) Provisional application No. 60/952,078, filed on Jul. 26, 2007.

(30) Foreign Application Priority Data

Sep. 6, 2007 (KR) ..... 10-2007-0090582

(51) Int. Cl.
*G10H 1/00* (2006.01)

(52) U.S. Cl. ..... 84/612; 84/636

(58) Field of Classification Search ..... 84/600–602, 84/612, 636, 652, 668
See application file for complete search history.

(56) References Cited

U.S. PATENT DOCUMENTS

| | | | | |
|---|---|---|---|---|
| 2006/0126452 | A1* | 6/2006 | Yamashita et al. | 369/30.23 |
| 2006/0189902 | A1* | 8/2006 | Takai et al. | 600/595 |
| 2006/0220882 | A1* | 10/2006 | Makino | 340/573.1 |
| 2007/0074253 | A1* | 3/2007 | Takai et al. | 725/46 |
| 2007/0261538 | A1* | 11/2007 | Takai et al. | 84/612 |
| 2009/0025539 | A1* | 1/2009 | Sagoo et al. | 84/609 |
| 2009/0088877 | A1* | 4/2009 | Terauchi et al. | 700/94 |

* cited by examiner

*Primary Examiner*—David S. Warren
(74) *Attorney, Agent, or Firm*—Sughrue Mion, PLLC

(57) ABSTRACT

A music reproduction device for recommending music suitable for a taste of a user is provided. When the music reproduction device reproduces music, a motion of the user is measured. A range of a tempo in which a tempo of music is matched with a tempo of the motion of the user is determined as a range of a preferred tempo of the user. Pieces of music to be recommended for the user are selected based on the determined range of the tempo. Thus, it is possible to accurately recommend pieces of music suitable for the taste of the user without an additional input for generating a recommendation list by the user.

11 Claims, 4 Drawing Sheets

METHOD AND DEVICE FOR SELECTING MUSIC TO BE RECOMMENDED FOR USER BY USING MUSIC REPRODUCTION DEVICE

CROSS-REFERENCE TO RELATED PATENT APPLICATION

This application claims priority from Korean Patent Application No. 10-2007-0090582, filed on Sep. 6, 2007 in the Korean Intellectual Property Office, and U.S. Provisional Application No. 60/952,078, filed on Jul. 26, 2007 in the U.S. Patent and Trademark Office, the disclosures of which are incorporated herein in their entirety by reference.

BACKGROUND OF THE INVENTION

1. Field of the Invention

Methods and devices consistent with the present invention relate to reproducing a music file, and more particularly, to selecting music to be recommended for a user by using a music reproduction device.

2. Description of the Related Art

As network techniques have been developed, types and amounts of digital media have increased. Accordingly, it can be difficult for media consumers to read and select all the contents. A media recommendation system becomes more important for a user to consume media. Many methods and techniques for accurately selecting pieces of music suitable for a taste of the user have been researched.

Currently, on-line music listening sites monitor that a pieces of music selected by a user and recommend pieces of music similar to the pieces of music selected by the user by reflecting the past selections of the pieces of music. For example, if a user frequently selects pieces of music of a specific musician, other pieces of music of the musician may be recommended for the user.

In addition, various parameters such as music genres, categories, music ranks, composers, and the like may be referred so as to select pieces of music to be recommended for the user. That is, the user can receive pieces of music suitable for a taste of the user by inputting parameters such as favorite music genres, favorite composers, and the like into a music recommendation system. In addition, some systems may find or recommend pieces of music by using a humming sound of the user.

Recently, according to a research on "Music and Mind" by the University of California, a person neuro-scientifically tends to unintentionally move according to a beat (tempo) of music, when listening to music that enables the person to feel comfortable. Regardless of this research, when the music having a tempo suitable for a taste of a person is reproduced, the person frequently tends to move in response to music by stamping or wagging their heads, while listening to the music.

Accordingly, if a motion of the user is recognized, it is possible to effectively recognize music suitable for the taste of the user without an active action such as an input of parameters for recommending pieces of music and/or an intentional humming sound. However, in the past, there was no method of recognizing a taste of a user for music by using a motion of the user.

SUMMARY OF THE INVENTION

The present invention provides a method and device for recognizing a motion of a user while a music reproduction device reproduces music and determining a favorite music tempo of the user based on the recognized motion.

According to an aspect of the present invention, there is provided a method of determining a preference of music of a user by using a music reproduction device, the method including sensing motions of the user while reproducing music, comparing a tempo of the sensed motions with a tempo of the music, and determining a range of a preferred tempo of the user based on a result of the comparing.

Motions of a head of the user may be sensed by using a three-dimensional (3D) motion sensor in the sensing of motions.

A tempo that is most similar to the tempo of the music among tempos of motions of a head of the user in the x-axis, y-axis, and z-axis motion directions may be compared with the tempo of the music in the comparison of the tempo of the sensed motions with the tempo of the music.

The range of the preferred tempo of the user may be determined based on how frequently the tempo of music matches with the tempo of the corresponding motions of the user in the determining of the range.

The tempos of the pieces of music may be base beats.

The method may further include generating a music list to be recommended for the user based on the determined range of the tempo.

According to another aspect of the present invention, there is provided a computer-readable recording medium having embodied thereon a computer program for executing the method.

According to another aspect of the present invention, there is provided a device for determining a preference of music of a user by using a music reproduction device, the device including a sensing unit which senses motions of the user while reproducing music, a comparison unit which compares a tempo of the sensed motions with tempo of the corresponding music, and a determination unit which determines a range of a favorite tempo of the user based on the comparison result.

The sensing unit may sense motions of a head of the user by using a 3D motion sensor.

The comparison unit may compare a tempo that is most similar to the tempo of the music among tempo of motions of a head of the user in the x-axis, y-axis, and z-axis motion directions with the tempo of the music.

The determination unit may determine the range of the preferred tempo of the user based on a frequency in which the tempo of the corresponding music matches with the tempo of the motion of the user.

The tempo of the music may be a base beat.

The device for determining a preference of music of a user by using a music reproduction device may further include a recommendation unit which generates a music list to be recommended for the user based on the determined range of the tempo.

Accordingly, since the music reproduction device measures a tempo of a natural motion of a user who listens to music and recognizes a taste of a user for music, the music reproduction device can accurately recommend pieces of music suitable for the taste of the user without an active humming sound or an input of parameters for recommending the pieces of music.

BRIEF DESCRIPTION OF THE DRAWINGS

The above and other aspects of the present invention will become more apparent by describing in detail exemplary embodiments thereof with reference to the attached drawings in which.

DETAILED DESCRIPTION OF EXEMPLARY EMBODIMENTS OF THE INVENTION

Hereinafter, the present invention will be described in detail by explaining exemplary embodiments of the invention with reference to the attached drawings.

Figure 1:
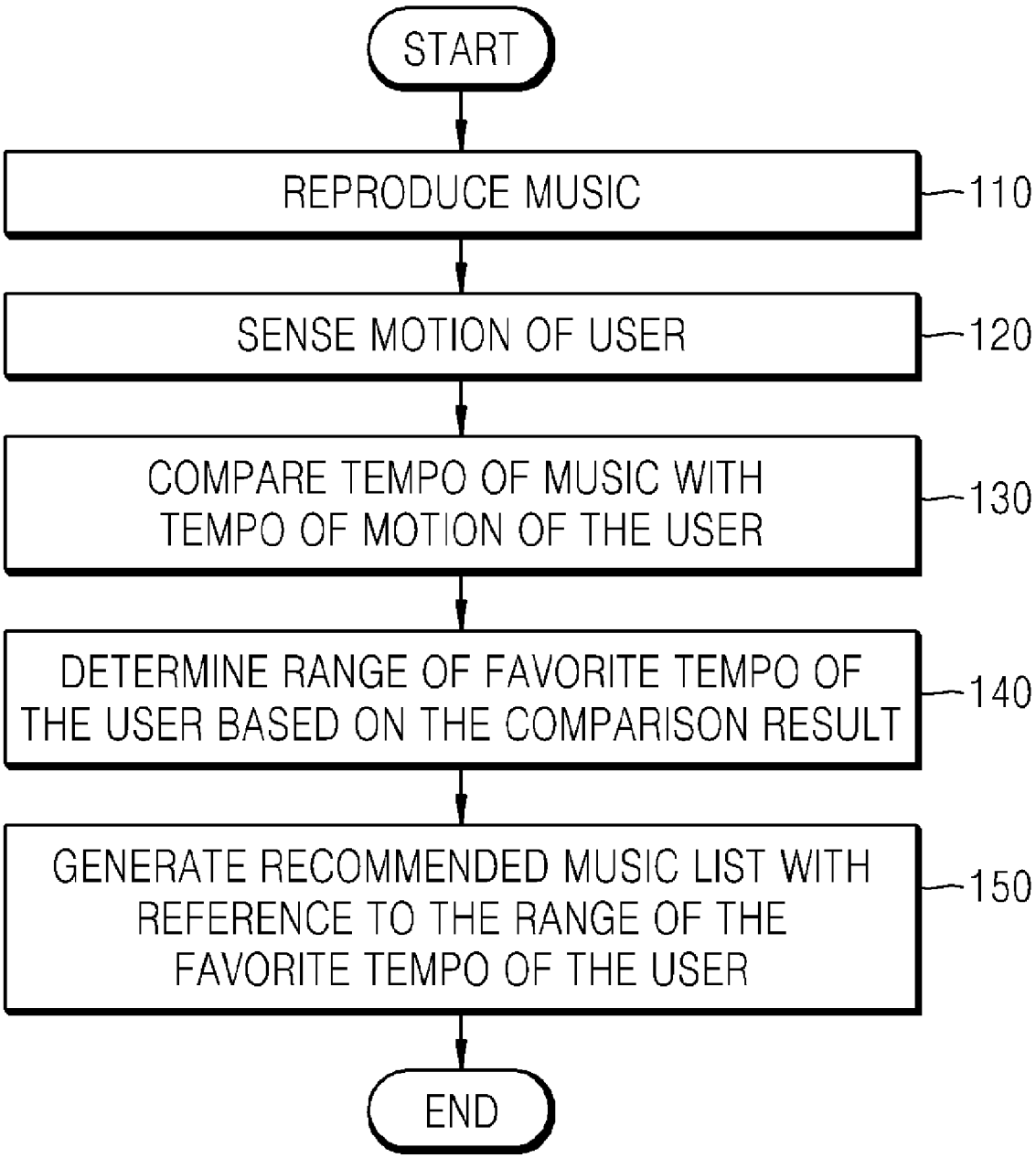
FIG. 1 is a flowchart of a procedure of generating a music list to be recommended for a user by a music reproduction device according to an exemplary embodiment of the present invention.

FIG. 1 is a flowchart of a procedure of generating a music list to be recommended for a user by a music reproduction device according to an exemplary embodiment of the present invention.

In operation 110, the music reproduction device reproduces music in response to an input of the user. The music may be stored in the music reproduction device or a remote server connected to the music reproduction device through a network.

In operation 120, the music reproduction device senses a motion of a user, while reproducing the music. That is, the music reproduction device monitors whether the user moves in response to a tempo of the music, while reproducing the music.

The motion of the user may be sensed by a three-dimensional (3D) motion sensor that is mounted on or incorporated in the music reproduction device or connected to the music reproduction device. In addition, it may be preferable to recognize a motion of a head of the user by mounting the 3D motion sensor on earphones or headset.

In operation 130, the music reproduction device compares a tempo of the music with a tempo of the motion of the user (hereinafter, referred to as a "user tempo"). That is, it is determined whether the tempo of the music is matched with or corresponds to the user tempo.

The tempo of the music may be determined through various types of software such as COOL EDIT and the like. Musical instruments with various frequency components may be used to perform a piece of music. Accordingly, a tempo of the piece of music may be changed based on a reference frequency for measuring a rhythm. The user recognizes a rhythm of a low sound, that is, a low frequency component, best. A music tempo of a low sound rhythm is referred to as a base beat. Accordingly, a tempo of music compared with the user tempo by using the music reproduction device according to the exemplary embodiment may be the base beat or a regular beat obtained by adding different light beats to the base beat. A light beat means a sound of which frequency components are higher than those of the base beat.

Since the motion of the user is recognized by the 3D motion sensor, the user tempo is changed depending on a reference direction selected from among x-axis, y-axis, and z-axis directions. Desirably, a tempo that is most similar to the tempo of the music may be considered as the user tempo. For example, if a tempo of a piece of music is 100 beats per minute (BPM), when the head of the user has a tempo of 20 BPM in the x-axis direction, a tempo of 100 BPM in the y-axis direction, and a tempo of 0 BPM in the z-axis direction, the user tempo of the piece of music is considered as 100 BPM.

In operation 140, the music reproduction device determines a range of a preferred or favorite tempo of the user based on the comparison result in operation 130. That is, after many pieces of music are reproduced, a tempo section in which the user frequently moves according to the music indicates the range of the favorite tempo of the user. The range of the tempo does not need to be a single section. That is, the range of the favorite tempo of the user may include two or more sections.

The music reproduction device according to the exemplary embodiment reproduces pieces of music with various tempos and determines the range of the favorite tempo of the user based on reactions of the user. Accordingly, as the number of reproduced pieces of music is increased, the range of the favorite tempo of the user may be slightly changed. However, as time elapses, accuracy of the range of the favorite tempo of the user is increased.

In operation 150, the music reproduction device generates a music list recommended for the user with reference to the range of the favorite tempo of the user. The music list is displayed for the user through a display unit of the music reproduction device. Accordingly, the user can select and receive pieces of music suitable for a taste of the user from a large music database, when connecting the music reproduction device to a personal computer (PC) in a house or a remote server.

Figure 2:
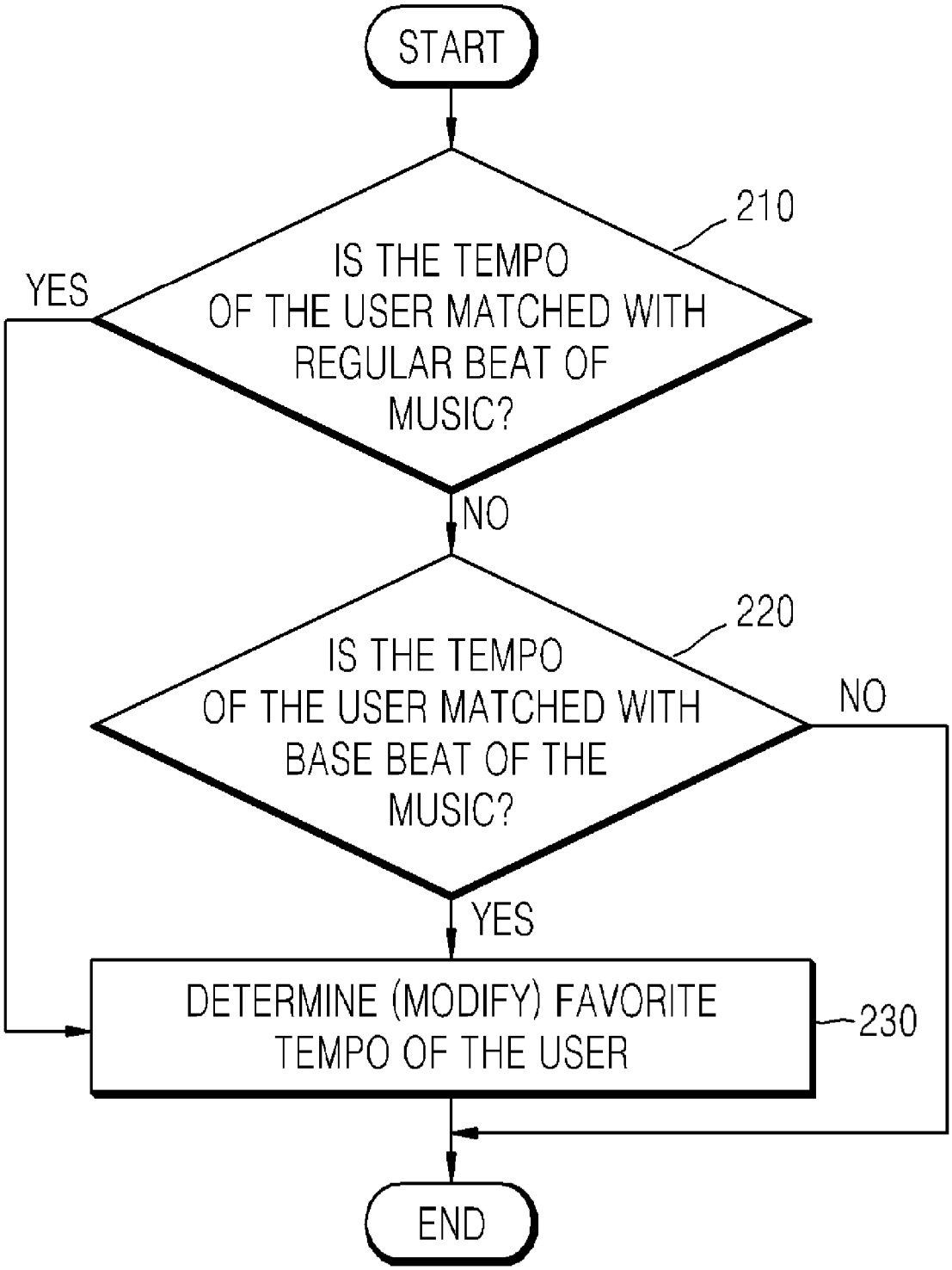
FIG. 2 is a flowchart of a procedure of determining a range of a favorite tempo of a user by using a music reproduction device according to an exemplary embodiment of the present invention.

FIG. 2 is a flowchart of a procedure of determining a range of a favorite tempo of a user by using a music reproduction device according to an exemplary embodiment of the present invention.

In operation 210, the music reproduction device determines whether the user tempo is matched with the regular beat of music. If the user tempo is matched with the regular beat of music, in operation 230, a range of a favorite tempo of the user is determined based on the user tempo (new data). If there is a previously determined range of the tempo, accuracy is increased by modifying the range by reflecting a value of a new user tempo.

In operation 220, if the user tempo is not matched with the regular beat of music, the user tempo is compared with the base beat of music. That is, it is determined whether the base beat of music is matched with the user tempo.

In operation 230, in a case where the base beat of music is matched with the user tempo, the range of the favorite tempo of the user is determined by reflecting the user tempo. In addition, when there is a previously determined range of the tempo, accuracy is increased by modifying the range by reflecting a value of a new user tempo.

Figure 3:
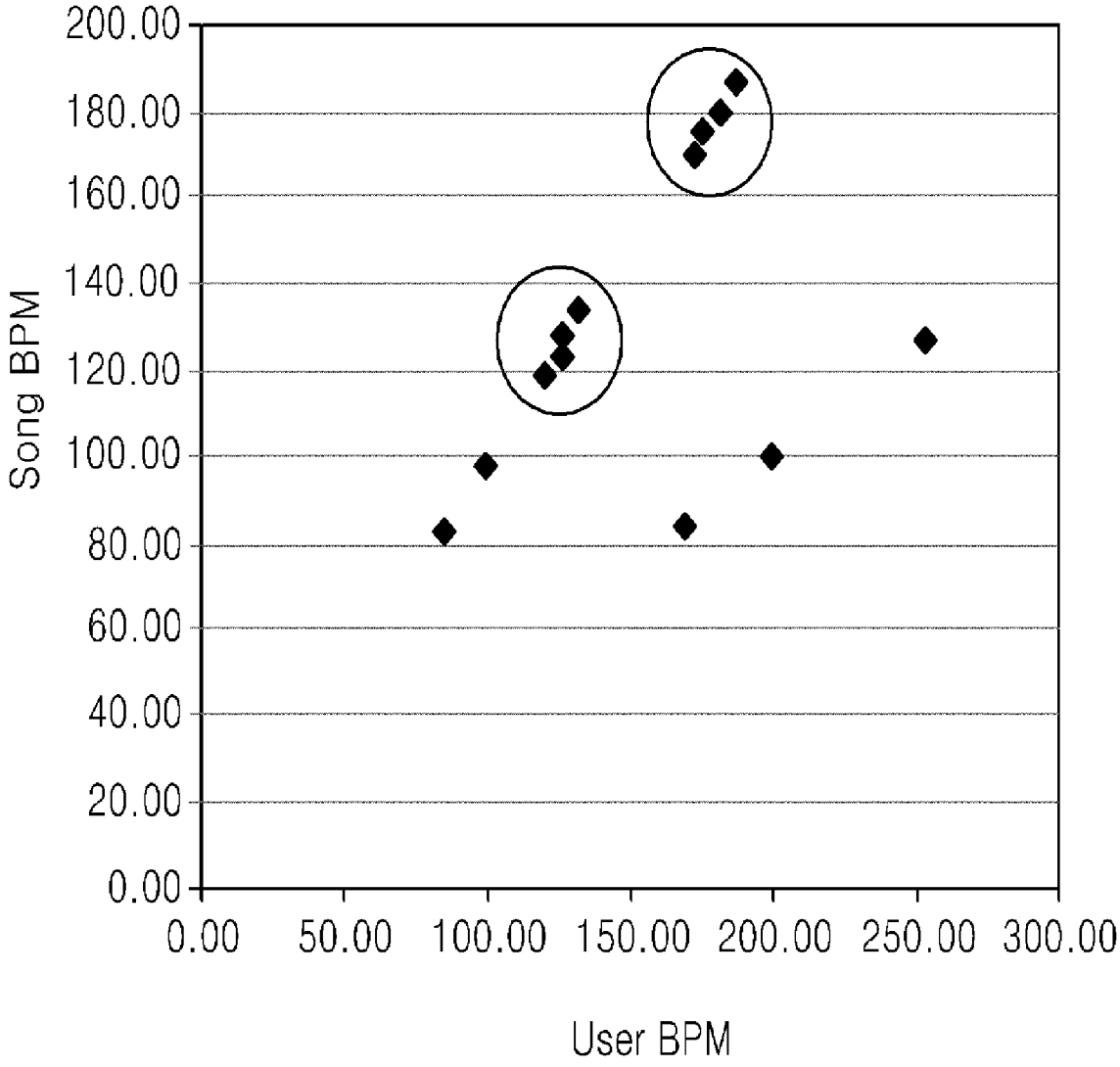
FIG. 3 is a graph for illustrating a method of determining a range of a favorite tempo of a user by using a music reproduction device according to an exemplary embodiment of the present invention.

FIG. 3 is a graph for illustrating a method of determining a range of a favorite tempo of a user by using a music reproduction device according to an exemplary embodiment of the present invention.

As shown in FIG. 3, the music reproduction device according to the exemplary embodiment records a user tempo, whenever reproducing a piece of music. As described above, a tempo of music may be calculated through predetermined software. The user tempo may be calculated through the 3D motion sensor. The x-axis of the graph of FIG. 3 indicates the user tempo. The y-axis indicates the tempo of music. Accordingly, one dot is added to the graph of FIG. 3, whenever a piece of music is reproduced. A range of a favorite tempo of the user is determined (modified) by reflecting the newly added dot.

A range of a tempo in which the user tempo is matched with the tempo of music indicates a range of a favorite tempo of the user. That is to say, a range having a high density of dots indicates the range of the favorite tempo of the user. Accordingly, since the density of dots in circles is high in the graph of FIG. 3, the range of the favorite tempo of the user is determined based on x-axis values of the dots in the circles.

Figure 4:
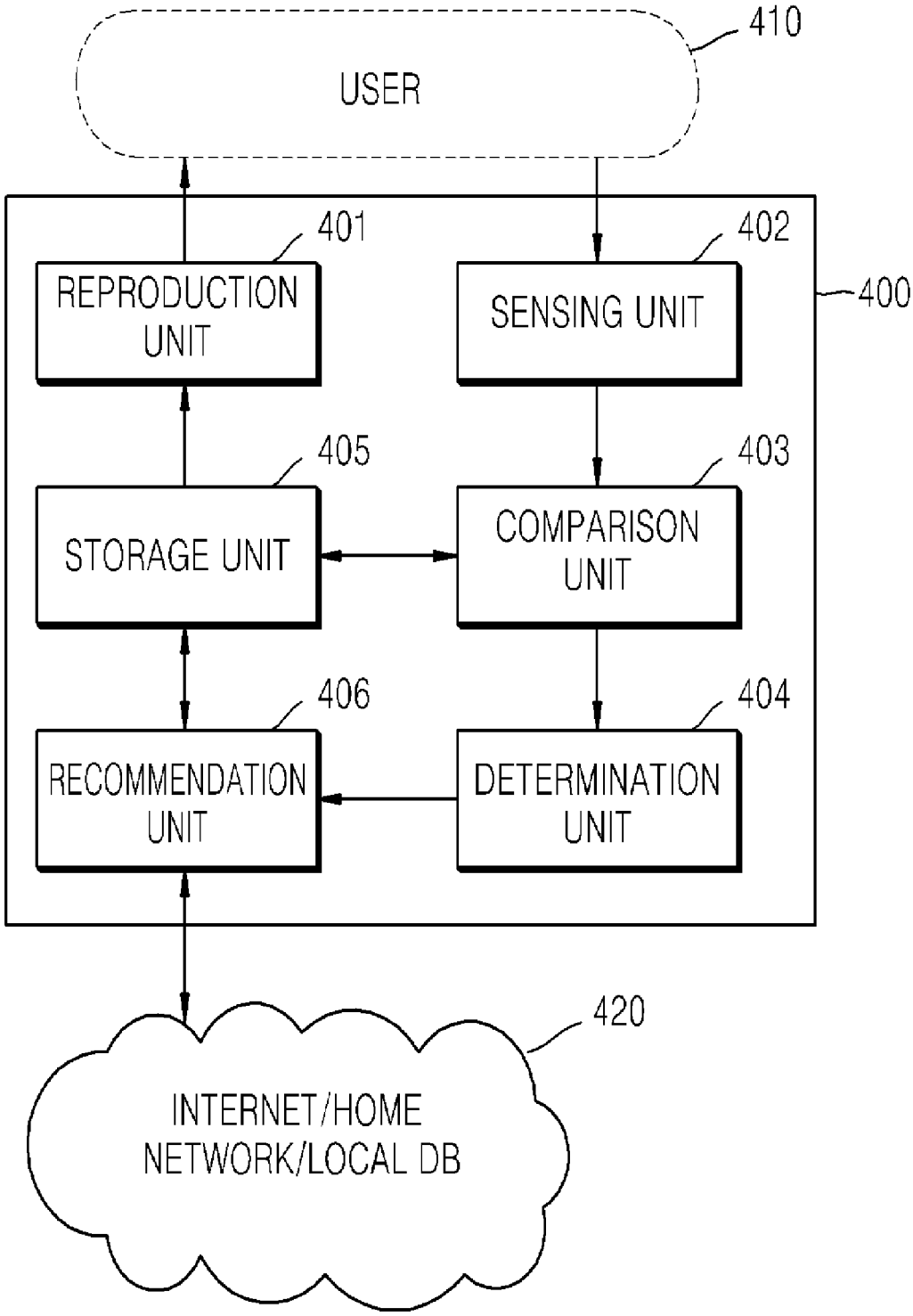
FIG. 4 illustrates a structure of a music reproduction device 400 according to an exemplary embodiment of the present invention.

FIG. 4 illustrates a structure of a music reproduction device 400 according to an exemplary embodiment of the present invention. The music reproduction unit 400 includes a reproduction unit 401, a sensing unit 402, a comparison unit 403, a determination unit 404, a storage unit 405 and a recommendation unit 406.

The reproduction unit 401 reproduces music files stored in a storage unit 405.

The sensing unit 402 senses a motion of a user 410, while the reproduction unit 401 reproduces the music files. Preferably, but not necessarily, the sensing unit 402 senses a motion of a head of the user 410 by using a 3D motion sensor. The sensing unit 402 may directly sense a motion of the head of the user 410. In a case where the 3D motion sensor is mounted on or incorporated in a headset rather than the music reproduction device 400, the sensing unit 402 serves to receive data on the sensed motion from the 3D motion sensor.

The comparison unit 403 compares a tempo of music that is being reproduced with a user tempo measured by the sensing unit 402. As described above, a tempo that is most similar to the tempo of music among tempos in x-axis, y-axis, and z-axis motion directions measured by the 3D motion sensor is considered as the user tempo and compared with the tempo of music.

The determination unit 404 determines a range of a favorite tempo of the user 410 based on the comparison result of the comparison unit 403. The determination unit 404 modifies the previously determined range of the tempo by measuring the user tempo, whenever a piece of music is reproduced. Accordingly, accuracy of the range of the favorite tempo of the user is improved, as time is elapsed.

A recommendation unit 406 generates a list of music to be recommended for the user with reference to the range of the favorite tempo of the user. That is, when the music reproduction device 400 is connected to the Internet, a home network, or a local PC, the music reproduction device 400 extracts only pieces of music suitable for a taste of the user from a large music database and recommends the pieces of music for the user.

The storage unit 405 stores music files, tempo information of the music files, and the like.

The exemplary embodiments of the present invention can be written as computer programs and can be implemented in general-use digital computers that execute the programs using a computer readable recording medium.

Examples of the computer readable recording medium include magnetic storage media (e.g., ROM, floppy disks, hard disks, etc.), optical recording media (e.g., CD-ROMs, or DVDs), and The exemplary embodiments of the present invention can also be written as computer programs which are transmitted as carrier waves (e.g., transmission through the Internet).

While the present invention has been particularly shown and described with reference to exemplary embodiments thereof, it will be understood by those skilled in the art that various changes in form and details may be made therein without departing from the spirit and scope of the invention as defined by the appended claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

What is claimed is:

1. A method of determining a preference of music of a user by using a music reproduction device, the method comprising:

sensing motions of a head of the user while music is reproduced by the music reproduction device, using a three-dimensional motion sensor;

comparing a tempo of the sensed motion of the head of the user in an x-axis direction to a tempo of the music, comparing a tempo of the sensed motion of the head of the user in a y-axis motion direction to the tempo of the music, and comparing the sensed motion of the head of the user in a z-axis motion direction to the tempo of the music;

determining a preferred tempo of the user from among the tempos of the sensed motions of the head of the user in the x-axis, the y-axis, and the z-axis directions that is most similar to the tempo of the music based on results of the comparing; and determining a range of the preferred tempo of the user based on a result of the determining the preferred tempo of the user.

2. The method of claim 1, wherein the determining the range of the preferred tempo of the user comprises determining the range of the preferred tempo of the user based on how frequently the tempo of music matches with the tempo of the corresponding motions of the user.

3. The method of claim 1, wherein the tempo of the music is a base beat.

4. The method of claim 1, further comprising generating a list of music to be recommended for the user based on the determined range of the tempo.

5. The method of claim 1, further comprising modifying a previously determined range of the tempo based the determined range of the tempo.

6. A computer-readable recording medium having embodied thereon a computer program for executing the method of claim 1.

7. A device for determining a preference of music of a user by using a music reproduction device, the device comprising:

a sensing unit which senses motions of a head of the user while music is being reproduced by the music reproduction device, using a three-dimensional motion sensor;

a comparison unit which compares a tempo of the sensed motion of the head of the user in an x-axis direction to a tempo of the music, compares a tempo of the sensed motion of the head of the user in a y-axis motion direction to the tempo of the music, and compares the sensed motion of the head of the user in a z-axis motion direction to the tempo of the music; and a determination unit which determines a preferred tempo of the user from among the tempos of the sensed motions of the head of the user in the x-axis, the y-axis, and the z-axis directions that is most similar to the tempo of the music based on a result of the comparison by the comparison unit and determines a range of the preferred tempo of the user based on the determined preferred tempo of the user.

8. The device of claim 7, wherein the determination unit determines the range of the preferred tempo of the user based on a frequency in which the tempo of the music matches with the tempo of the motion of the user.

9. The device of claim 7, wherein the tempo of the music is a base beat.

10. The device of claim 7, further comprising a recommendation unit which generates a list of music to be recommended for the user based on the determined range of the tempo.

11. The device of claim 7, wherein the determination unit modifies a previously determined range of the tempo based the determined range of the tempo.

* * * * *